US006492968B1

(12) United States Patent
Yuan et al.

(10) Patent No.: US 6,492,968 B1
(45) Date of Patent: Dec. 10, 2002

(54) METHOD FOR DETECTING COLOR MIXING DEFECTS ON LIQUID CRYSTAL MONITORS

(75) Inventors: Bin Yuan, Tienchih (CN); Vam Chang; Kuang-Hsin Lin, both of Taipei (TW)

(73) Assignee: Inventec Corporation, Taipei (TW)

( * ) Notice: Subject to any disclaimer, the term of this patent is extended or adjusted under 35 U.S.C. 154(b) by 0 days.

(21) Appl. No.: 09/426,485

(22) Filed: Oct. 26, 1999

(51) Int. Cl.[7] ..... G09G 3/36

(52) U.S. Cl. ..... 345/88; 345/87; 324/770

(58) Field of Search ..... 345/87, 88, 89, 345/98, 99, 100, 204, 205, 206, 207; 382/141, 144, 145, 147, 149; 324/770, 158.1

(56) References Cited

U.S. PATENT DOCUMENTS 4,825,201 A * 4/1989 Watanabe et al. ..... 345/87
5,363,037 A * 11/1994 Henley et al. ..... 324/158.1
6,075,880 A * 6/2000 Kollhof et al. ..... 382/141
6,281,700 B1 * 8/2001 Matsueda ..... 324/770
6,337,677 B1 * 1/2002 Higashi ..... 345/100

* cited by examiner

*Primary Examiner*—Xiao Wu
(74) *Attorney, Agent, or Firm*—Powell Goldstein Frazer & Murphy LLP

(57) ABSTRACT

A method for detecting defects when mixed colors among color channels on a liquid crystal monitor is disclosed. The disclosed method utilizes the interference of four channels of red, green, blue and white colors to check whether a detected liquid crystal monitor can normally show the mixed colors. A rectangular channel drawing is shown on a liquid crystal monitor; wherein the most upper left point, the most upper right point, the most lower left point, and the most lower right point are respectively allocated by red, green, blue, and white pixels. Each color channel then extends separately along the diagonal direction and accompanied with color intensity gradually decreasing to obtain an interference diagram that contains several arc stripes on the rectangular drawing. Accordingly, those defective pixels will be clearly indicated in the rectangular channel drawing because they are usually flashing visually. Additionally, color sensors can be employed to further analyze the channel weights of each pixel of the detected liquid crystal monitor, and the detecting information can be further illustrated by using a menu or a display window according to the display mode of a liquid crystal monitor currently used.

18 Claims, 4 Drawing Sheets

METHOD FOR DETECTING COLOR MIXING DEFECTS ON LIQUID CRYSTAL MONITORS

BACKGROUND OF THE INVENTION

1. Field of the Invention

The present invention relates to a method for detecting color mixing defects, and more particularly, to a method for detecting mixing defects of color channels when displayed on liquid crystal monitors.

2. Description of the Prior Art

The approach of semiconductor technology brings a liquid crystal monitor (LCM) to be a broadly used display device today. However, a ready-made liquid crystal monitor unavoidably includes some defective pixels due to mass-production. Methods for detecting those defective pixels are thus commonly employed before sale. Conventional methods for detecting defects of the liquid crystal monitor must adopt the direct check that displays three independent color channels such as red, green, and blue as described in FIG. 1A. Those conventional methods verify whether or not the tested color channel is defective, as determined by the three independent channels. For example, referring to FIG. 1B, a defective liquid crystal monitor usually shows a plurality of abnormal points that exist on the red, green, and blue channels, respectively.

Conventional methods are limited in that they can only detect defects of a single color channel, but cannot detect defects derived from mixed channels. Typically, a liquid crystal monitor containing errors caused by color mixing usually shows twinkling regions because the defective pixels derived from color mixing are usually continuously flashing or frequently vary their colors. For example, referring to the upper portion of FIG. 3, a girl dressed up in a blue shirt is abnormally depicted because portions of the blue skirt are shown with other colors such as yellow. Unfortunately, adopting the conventional method cannot confirm the above errors. Additional detecting methods are thus required to prevent breakdown products from being sold. A need has therefore arisen for a method for overcoming the above mentioned disadvantages so that defective pixels due to color mixing can be detected.

SUMMARY OF THE INVENTION

According to the above objects, the present invention provides a novel method for detecting defects on a liquid crystal monitor when mixed colors among color channels. The disclosed method utilizes the interference of four color channels such as red, green, blue and white colors to check whether the detected liquid crystal monitor can normally show the mixed colors thereon. The embodiment of the present invention is to draw a rectangular drawing on the liquid crystal monitor, wherein the most upper left point, the most upper right point, the most lower left point, and the most lower right point are respectively allocated by red, green, blue, and white pixels. Each color channel then extends separately along the diagonal direction and accompanied with color intensities gradually decreasing to obtain an interference diagram that contains several arc stripes on the rectangular drawing. Accordingly, the rectangular drawing can faithfully display where the abnormal pixels are if any abnormal situation occurs at color mixing. Additionally, information of the embodiment can be further illustrated by using a menu or a display window according to display the mode of a liquid crystal monitor currently used.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DESCRIPTION OF THE PREFERRED EMBODIMENT

The embodiments of the present invention will now be described in detail with reference to the figures. The present invention provides a novel method of detecting defects of mixed color channels on a liquid crystal monitor. The detection method is achieved by the interference of red, green, blue and white colors, which can be applied to various display modes, such as a mode with the resolution ranging from 640×480×32 bits to 1024×768×32 bits or above. For example, the display mode 640×480×256 indicates 256 kinds of color variation at resolution of 640×480 pixels. To elucidate the confirmation results, channels appearing on a liquid crystal monitor as much as possible are required, thereby making it desirable for the operator to observe the confirmation results. The present invention discloses whether or not the liquid crystal monitor can show the channels of the red, green, blue, and white colors instead of applying the verification for the individual channels of red, green, and blue conventionally.

Figure 1A:
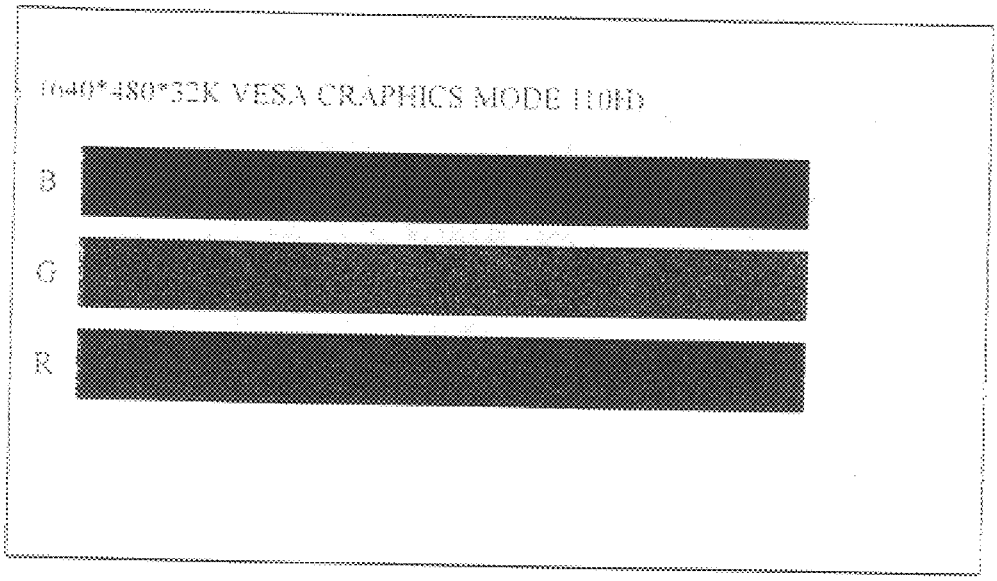
FIG. 1A is a schematic drawing illustrative of when conventional methods for detecting single color channel is employed, wherein all color channels are normally displayed.
Figure 1B:
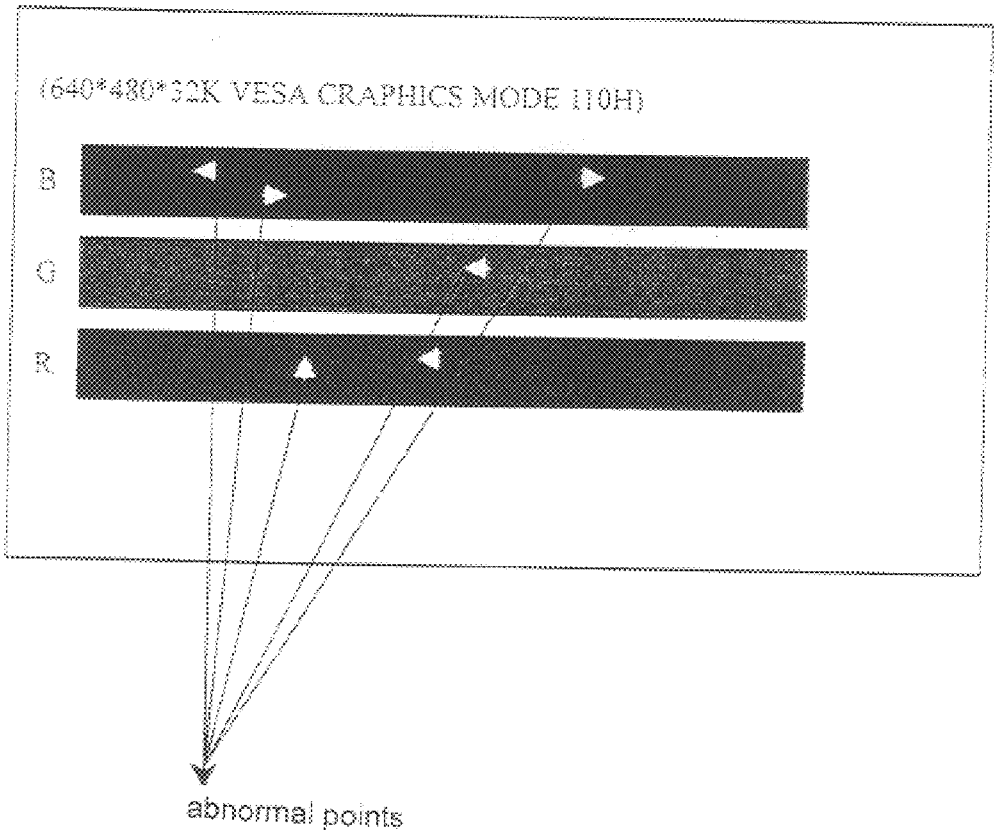
FIG. 1B is a schematic drawing illustrative of when conventional methods for detecting a single color channel is employed, wherein some defective pixels are shown on three color channels.
Figure 2:
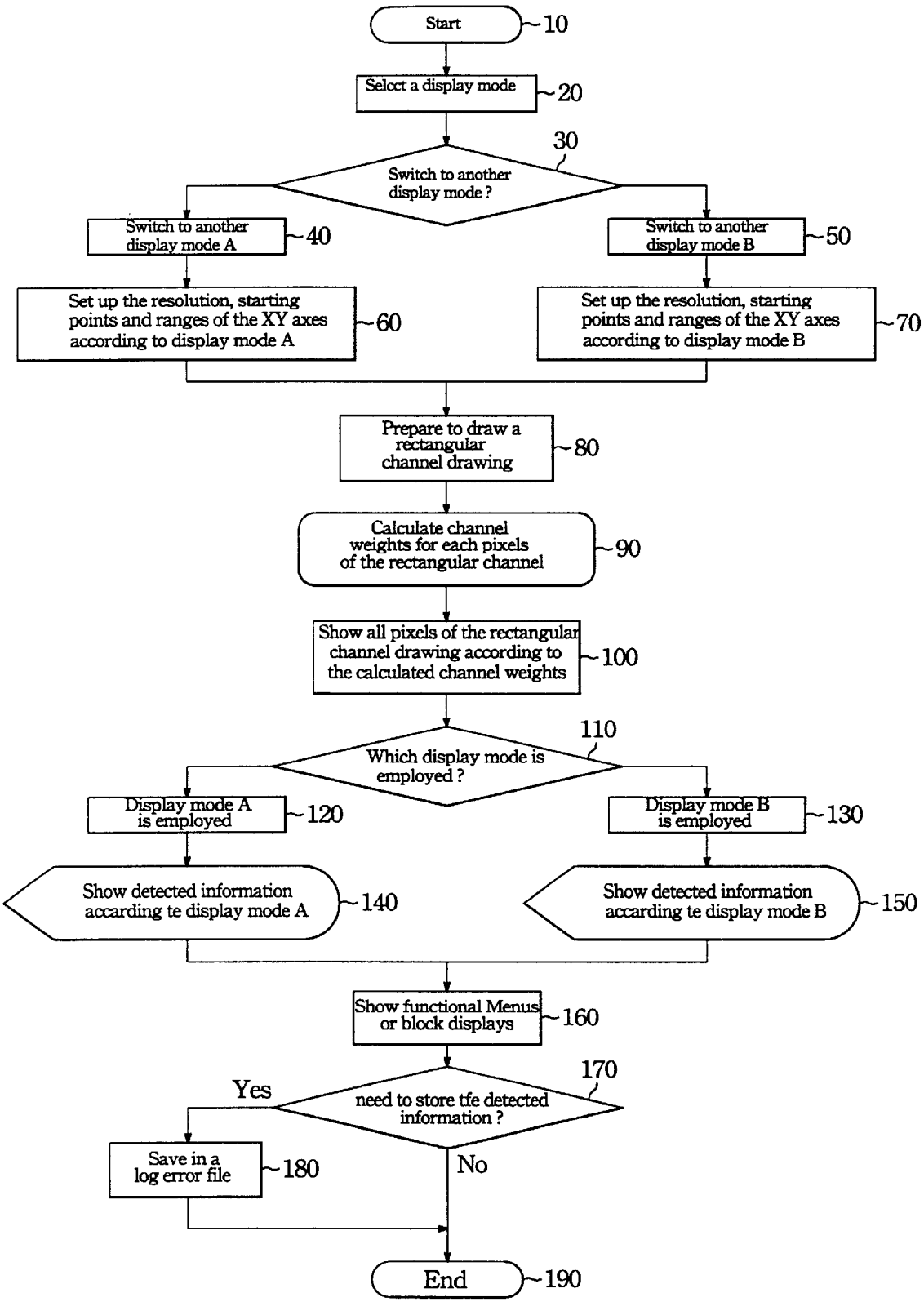
FIG. 2 shows a diagram illustrative of the flow chart of the embodiment.
Figure 3:
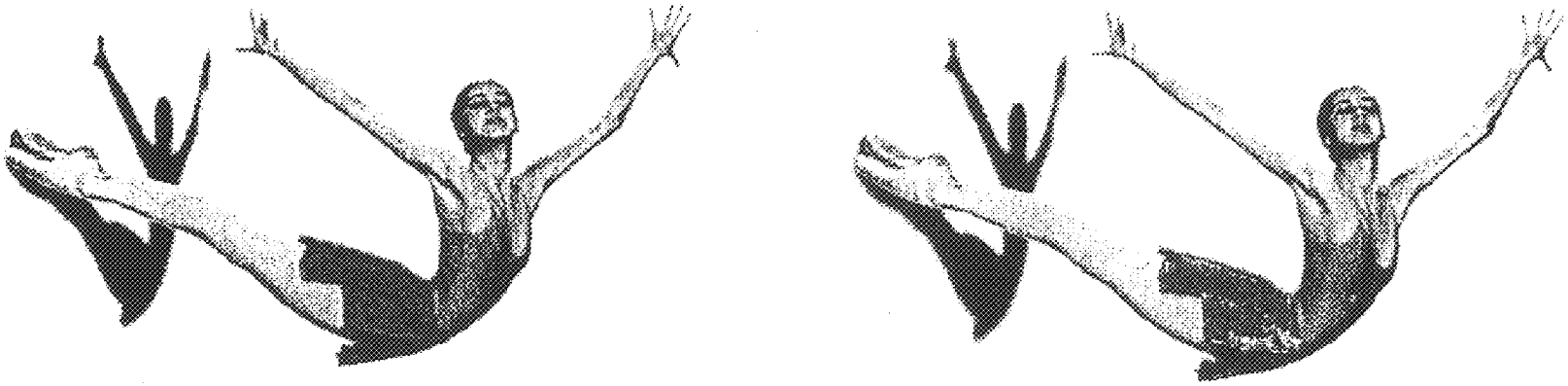
FIG. 3 shows two schematic diagrams illustrative of when pixels are normal and abnormally displayed.

The disclosed method displays a rectangular channel drawing for observing and determining the quality of the detected liquid crystal monitor. A flow chart representing the embodiment of the present invention is shown in FIG. 2 for illustrating the following description. The display modes being detected can be the currently used one, or entered from the start verification (steps 10, 20 and 30) because a liquid crystal monitor usually provides various display modes with different resolutions for use. For example, the resolution of the display mode A is 640×480×16.8 bits (step 40), and the resolution of the display mode B is 800×600×16.8 bits (step 50). As noted, the above-preferred resolutions of the embodiment are illustrative of the merits of the present invention rather than its limitations. The present method should depend on the practical applications and requirements. Afterward, the resolution, the starting points and ranges of the X, Y axes (steps 60, 70), can be set according to the selected display mode for verification later.

After setting the parameters of the aforementioned steps, the rectangular channel drawing according to the embodiment can be drawn by two of the X, Y axis loops (step 80). Four corners of the rectangular drawing, such as the most upper left point, the most upper right point, the most lower left point, the most lower right point, are respectively drawn as red, green, blue, and white pixels. Each color channel then extends along the diagonal directions of the rectangular drawing and is accompanied with channel intensities gradually decreasing (described later). Interference appears when one color channel comes across another channel, ultimately forming arc stripes on the rectangular drawing. According to calculating results of the numerical weights of each pixel based on the red, green, blue, and white color channels respectively for filling in the channel point (steps 90, 100), the following formula calculates the primary channel weight of each point:

$$F(x_1, y_1, x_2, y_2)=255-\mathrm{sqrt}((x_2-x_1-\mathrm{DIFF_X})*(x_2-x_1-\mathrm{DIFF_X})+(y_2-y_1-\mathrm{DIFF_Y})*(y_2-y_1-\mathrm{DIFF_Y}))$$

Where "F " denotes the computed channel weight (i.e., intensity), $(x_1, y_1)$ represents the starting point of a color channel, $(x_2, y_2)$ represents the currently forward point of the color channel, and DIFF_X and DIFF_Y are the definitions of the X, Y-axes under various display modes, respectively. Therefore, any pixel will contain four channel weights derived from the four most corners, which indicates that any pixel will show the color mixed by the computed four channel weights respectively derived from the above equation. Please note that the rectangular drawing is extended to the largest display area of the detected liquid crystal monitor in the embodiment, however, the operator can allocate the aforementioned starting points at any positions on the detected liquid crystal monitor. Then, the detected information can be shown according to the selected display mode (steps 110 to 150). Additionally, the operator can switch the current display mode to another for showing the detected information if necessary.

The information of that selected display mode can be shown on functional menus (step 160), which can be windows or block displays. Furthermore, the information can be optionally saved in a log file for reference for the future if the errors of mixed channels are detected by the determination of the operator (steps 170, 180). The flow of FIG. 2 terminates to confirmation at step 190. Finally, a rectangular drawing with interference arc stripes is then generated according to the aforementioned steps. It is evident that computational cost is significantly degraded than before because any operator can write a simple detecting program to test a liquid crystal monitor according to the disclosed method.

Moreover, for the purpose of accurately detecting out the defective pixels, color sensors can be used simultaneously to compare with the channel weights derived from the above equation. Additional thresholds may thus require for deciding whether a pixel is concluded as defective. The comparison results can also be displayed by using block displays or stored in log files as described above. Additionally, although the colors employed in the embodiment are red, green, blue, and white, any colors that can be clearly distinguished by color sensors, or at least distinguished by human eyes to indicate defective pixels, can be applied in the disclosed method. For example, the conventional CMY model that employs clay, magenta, yellow colors, can replace the use of red, green, and blue colors in the above descriptions. Furthermore, even the white color can be further instituted by black color in the invention, which implies that the CMYK model can also be employed in the invention.

Figure 4:
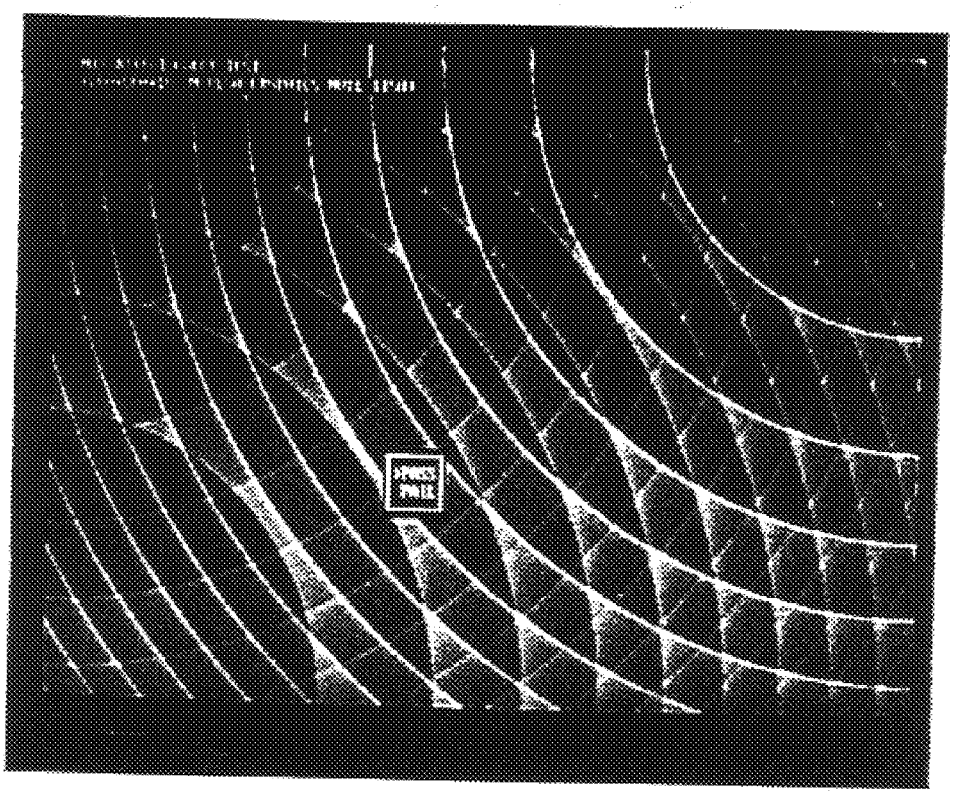
FIG. 4 shows a schematic diagram illustrative of when a normal condition is depicted on a liquid crystal monitor according to the present invention.
Figure 5:
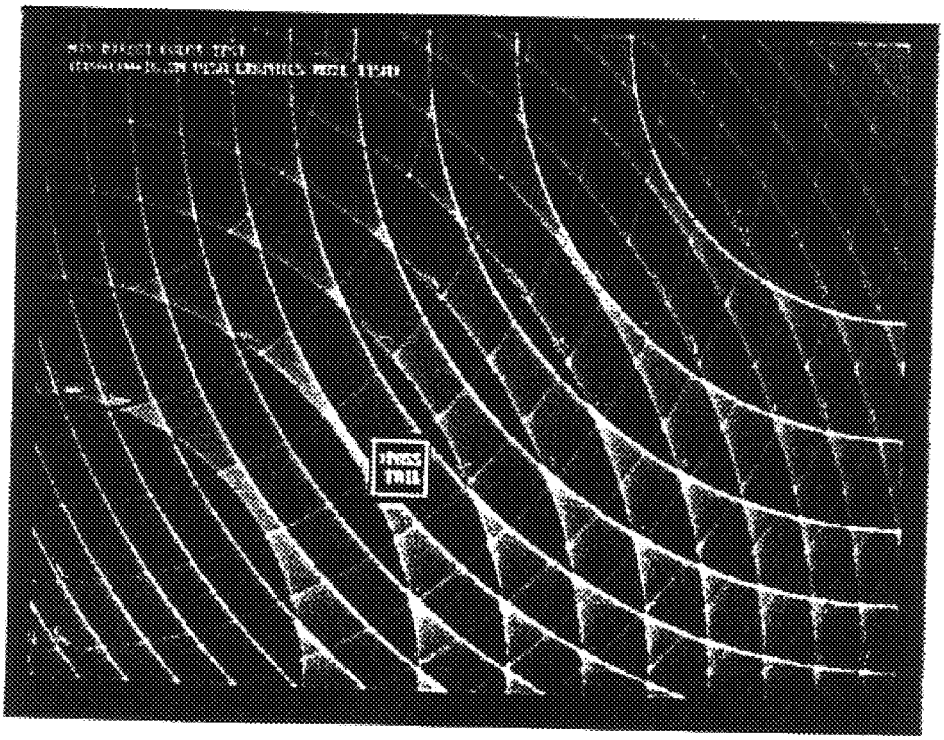
FIG. 5 shows a schematic diagram illustrative of when an abnormal condition is depicted on a liquid crystal monitor according to the present invention.

Schematic diagrams that are generated in the embodiment are given hereinafter, wherein FIGS. 4 and 5 respectively illustrate normal and abnormal situations. As noted, when the detected liquid crystal monitor is normal, the rectangular channel drawing shows a normal and pure arc channels interference stripes such as the drawing in FIG. 4. On the other hand, the rectangular channel drawing shows unusual arc channel interference stripes if the detected liquid crystal monitor includes defective pixels due to color mixing. Those defective pixels, for example, usually show incorrect colors, or look flashing at visually due to frequently changing their colors as shown in FIG. 5. However, the novel method can indicate where and how many the defective pixels are. Then the operator can decide whether the detected liquid crystal monitor passes the specification or not by using the detected information.

Elementary advantages offered by the disclosed method are described as follows. Firstly, the defective pixels caused from color mixings can be detected therefore preventing the sale of any liquid crystal monitor that is out of compliance with specifications. Secondly, any operator can write a simple detecting program to detect a liquid crystal monitor based on the spirit of the present invention. Less computational cost is required than in conventional approaches.

As is understood by a person skilled in the art, the foregoing preferred embodiments of the present invention are illustrative of the present invention rather than limiting of the present invention. They are intended to cover various modifications and similar arrangements included within the spirit and scope of the appended claims, the scope of which should be accorded the broadest interpretation so as to encompass all such modifications and similar structures.

What is claimed is:

1. A method for detecting defects caused by mixing colors on a liquid crystal monitor, said method comprising the steps of:

displaying a channel drawing on said liquid crystal monitor, wherein a first reference color is allocated on a first corner of said channel drawing, a second reference color is allocated on a second corner of said channel drawing, a third reference color is allocated on a third corner of said channel drawing, a fourth reference color is allocated on a fourth corner of said channel drawing, an intensity of said first reference color decreasing toward a direction to said fourth reference corner, an intensity of said second reference color decreasing toward a direction to said third reference corner, an intensity of said third reference color decreasing toward a direction to said second reference corner, an intensity of said fourth reference color decreasing toward a direction to said first reference corner, wherein each pixel of said channel drawing is shown by mixing said intensity of said first reference color, said intensity of said second reference color, said intensity of said third reference color, and said intensity of said fourth reference color;

generating a test message according to said channel drawing; and deciding whether said liquid crystal monitor to be defective by using said test message.

2. The method according to claim 1, wherein said channel drawing is a rectangular drawing.

3. The method according to claim 2, wherein an area of said rectangular drawing equals to a largest display area of said liquid crystal monitor.

4. The method according to claim 1, wherein said first reference color is red, said second reference color is green, said third reference color is blue, and said fourth reference color is white.

5. The method according to claim 1, wherein said first reference color is clay, said second reference color is magenta, said third reference color is yellow, and said fourth reference color is black.

6. The method according to claim 1, wherein said channel drawing is shown according a resolution and color levels of said liquid crystal monitor.

7. The method according to claim 1, further comprising a color sensor to analyze channel weights of each pixel of said channel drawing.

8. The method according to claim 7, wherein said test message comprises information generated by said color sensor.

9. A method for detecting defects caused by mixing colors on a liquid crystal monitor, said method comprising the steps of:

displaying a rectangular channel drawing on said liquid crystal monitor, wherein a first reference color is allocated on a first corner of said rectangular channel drawing, a second reference color is allocated on a second corner of said rectangular channel drawing, a third reference color is allocated on a third corner of said rectangular channel drawing, a fourth reference color is allocated on a fourth corner of said rectangular channel drawing, an intensity of said first reference color decreasing toward a direction to said fourth reference corner, an intensity of said second reference color decreasing toward a direction to said third reference corner, an intensity of said third reference color decreasing toward a direction to said second reference corner, an intensity of said fourth reference color decreasing toward a direction to said first reference corner, wherein each pixel of said rectangular channel drawing is shown by mixing said intensity of said first reference color, said intensity of said second reference color, said intensity of said third reference color, and said intensity of said fourth reference color, and an area of said rectangular channel drawing equals to a largest display area of said liquid crystal monitor;

generating a test message according to said rectangular channel drawing; and deciding whether said liquid crystal monitor to be defective by using said test message.

10. The method according to claim 9, wherein said first reference color is red, said second reference color is green, said third reference color is blue, and said fourth reference color is white.

11. The method according to claim 9, wherein said first reference color is clay, said second reference color is magenta, said third reference color is yellow, and said fourth reference color is black.

12. The method according to claim 9, wherein said channel drawing is shown according a resolution and color levels of said liquid crystal monitor.

13. The method according to claim 9, further comprising a color sensor to analyze channel weights of each pixel of said channel drawing.

14. The method according to claim 13, wherein said test message comprises information generated by said color sensor.

15. A method for detecting defects caused by mixing colors on a liquid crystal monitor, said method comprising the steps of:

displaying a rectangular channel drawing on said liquid crystal monitor, wherein a red pixel is allocated on a first corner of said rectangular channel drawing, a green pixel is allocated on a second corner of said rectangular channel drawing, a blue pixel is allocated on a third corner of said rectangular channel drawing, a white pixel is allocated on a fourth corner of said rectangular channel drawing, an intensity of said red pixel decreasing toward a direction to said fourth reference corner, an intensity of said green pixel decreasing toward a direction to said third reference corner, an intensity of said blue pixel decreasing toward a direction to said second reference corner, an intensity of said white pixel decreasing toward a direction to said first reference corner, wherein each pixel of said rectangular channel drawing is shown by mixing said intensity of said red pixel, said intensity of said green pixel, said intensity of said blue pixel, and said intensity of said white pixel, and an area of said rectangular channel drawing equals to a largest display area of said liquid crystal monitor;

generating a test message according to said rectangular channel drawing; and deciding whether said liquid crystal monitor to be defective by using said test message.

16. The method according to claim 15, wherein said rectangular channel drawing is shown according a resolution and color levels of said liquid crystal monitor.

17. The method according to claim 15, further comprising a color sensor to analyze channel weights of each pixel of said channel drawing.

18. The method according to claim 15, wherein said test message comprises information generated by said color sensor.

* * * * *